US005642836A

United States Patent [19]

Merriweather, Jr.

[11] Patent Number: 5,642,836

[45] Date of Patent: Jul. 1, 1997

[54] SINGLE PIECE TOWEL DISPENSER

[76] Inventor: Frank Merriweather, Jr., 131 ½ E. 220th St., Carson, Calif. 90745

[21] Appl. No.: 523,356

[22] Filed: Sep. 5, 1995

[51] Int. Cl.[6] ..... B65H 1/00

[52] U.S. Cl. ..... 221/62; 221/61; 221/33; 221/63; 221/281; 221/54

[58] Field of Search ..... 221/44, 53, 54, 221/63, 33, 281, 61, 62

[56] References Cited

U.S. PATENT DOCUMENTS

| | | | |
|---|---|---|---|
| D. 332,194 | 1/1993 | Hines . | |
| 1,599,175 | 9/1926 | Hellstrom | 221/62 |
| 1,622,597 | 3/1927 | Mangold | 221/62 |
| 1,827,904 | 11/1931 | Parsons | 221/62 |
| 2,195,727 | 4/1940 | Jensen | 221/62 |
| 2,270,914 | 1/1942 | Williams | 221/61 |
| 3,071,288 | 1/1963 | Ganther | 221/62 |
| 3,269,592 | 8/1966 | Slye et al. | 221/44 |

FOREIGN PATENT DOCUMENTS

| | | | |
|---|---|---|---|
| 690187 | 4/1953 | Sweden | 221/62 |

*Primary Examiner*—William E. Terrell
*Assistant Examiner*—Khoi H. Tran
*Attorney, Agent, or Firm*—Pretty, Schroeder & Poplawski

[57] ABSTRACT

A towel dispenser consisting of a single unitary molded piece and having a container with a front, a back, right and left sides, and a top, forming a box with an open bottom, arcuate slots in each side, and a bottom member joined to the back with a living hinge and having opposed tabs extending laterally for riding in the slots, and an access opening for passage of a towel from the interior of the container, with the bottom member moveable from an initial position out of the box to a dispensing position with the tabs in the slots for closing the bottom and supporting towels thereon, and to an upward loading position for insertion of towels upward into the box past the bottom member, with the bottom member returning to the dispensing position following insertion of towels.

2 Claims, 2 Drawing Sheets

FIG. 1
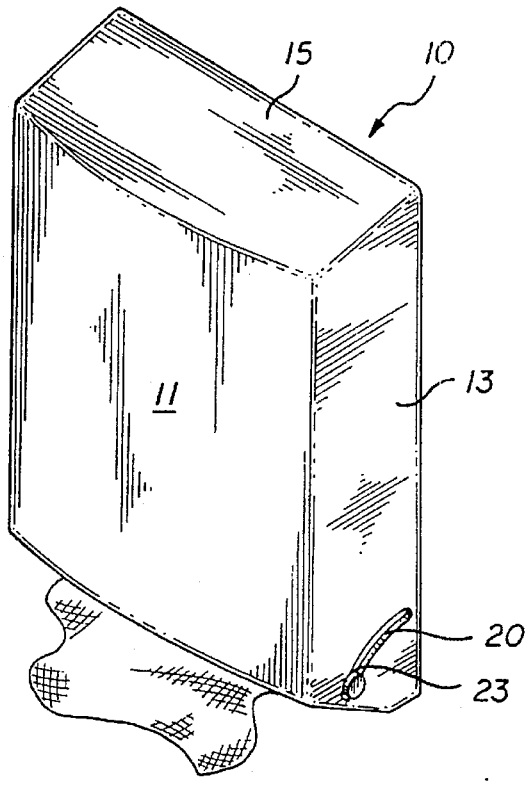
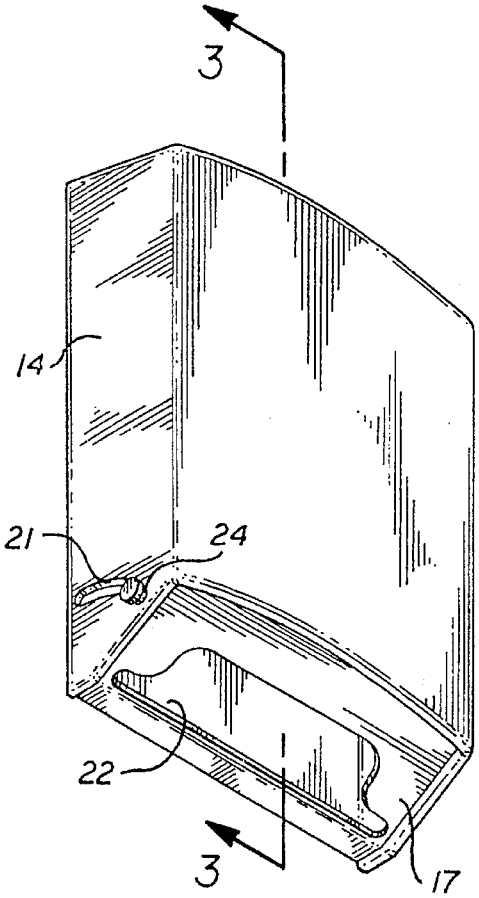
FIG. 2
FIG. 3
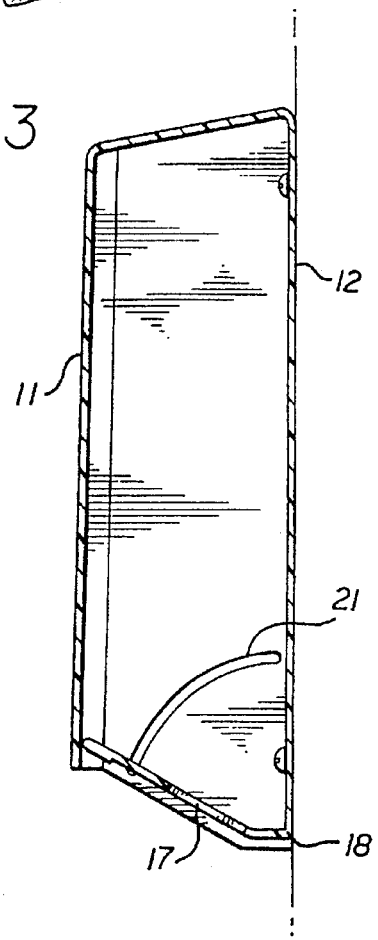
FIG. 6
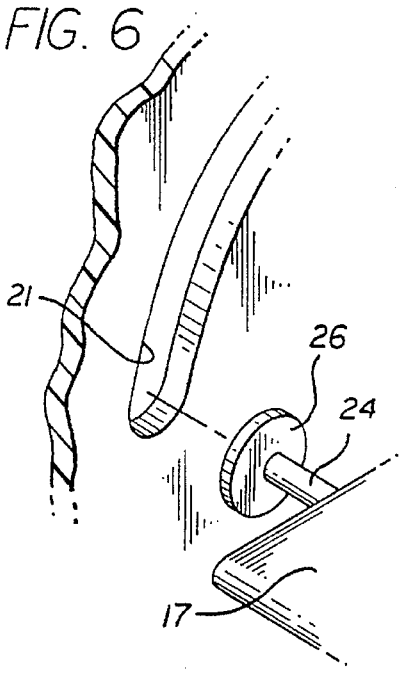

SINGLE PIECE TOWEL DISPENSER

BACKGROUND OF THE INVENTION

This invention relates to dispensers for paper towels and the like and in particular to a new and improved towel dispenser molded as a single piece of plastic.

Dispensers for paper towels have been in use for many years and one form is shown in U.S. patent Des. 332,194. These prior art dispensers are formed of several pieces of sheet metal or plastic which are joined by spot welding or rivets and by hinges. In some models, the top or the front is hinged to swing open for loading of the towels. In other models, the bottom with the dispensing slot is hinged to swing upward and permit loading from the bottom, with the bottom then swinging down against a stop for supporting the stack of towels on the bottom.

It is an object of the present invention to provide a new and improved towel dispenser which is formed as a single molded piece, thereby eliminating all assembly operations with a resultant reduction in cost.

Another advantage is since no assembly is required, the product can be inserted into its package by the mold operator while the mold is cycling, thus reducing the cost even further. Also, quality is improved since there are no spot welds or rivets which could fail. Additionally, there are no separate parts which must be put into and taken out of stock.

SUMMARY OF THE INVENTION

The towel dispenser of the invention consists of a single unitary molded piece in the form of a container with a front, a back, right and left sides, and a top, forming a box with an open bottom, and with a slot in each of the sides. A bottom member is joined to the back with a living hinge and has opposed tabs extending laterally for riding in the slots, and an access opening for passage of a towel from the interior, with the bottom member moveable from an initial position out of the box to a dispensing position with the tabs in the slots for closing the bottom and supporting towels thereon, and to an upward loading position for insertion of towels upward into the box past the bottom member, with the bottom member returning to the dispensing position following insertion of towels. In the preferred embodiment, the slots are arcuate and the tabs have knobs on the outer ends thereof.

Other objects, advantages, features and results will more fully appear in the course of the following description.

BRIEF DESCRIPTION OF THE DRAWINGS

FIG. 1 is a perspective view taken from above and showing the presently preferred embodiment of the towel dispenser of the invention;

FIG. 2 is a view similar to that of FIG. 1 taken from below;

FIG. 3 is a sectional view taken along the line 3—3 of FIG. 2;

FIG. 6 is an enlarged partial view showing details of the tab and knob construction.

DESCRIPTION OF THE PREFERRED EMBODIMENT

Figure 4:
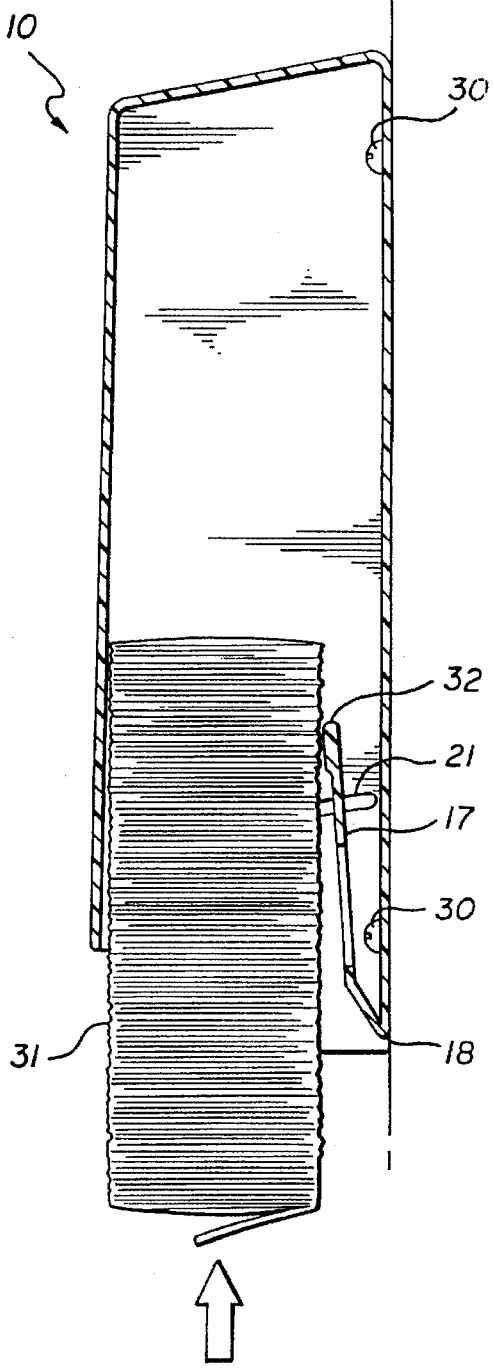
FIG. 4 is an enlarged sectional view showing a stack of towels being loaded into the dispenser.

The dispenser includes a container 10 with front 11, back 12, right side 13, left side 14, and top 15. The container is molded with an open bottom.

A bottom member 17 is molded integral with the back 12, with a living hinge 18 at the junction of the bottom member and back. A living hinge is a conventional construction widely used in plastic molded products for joining two portions of the product, while permitting one portion to pivot or rotate relative to the other portion. Typically in the container as molded, the bottom member 17 and the back 12 will be coplanar.

A slot 20 is provided in the side 13 and a similar slot 21 is provided in the side 14. Preferably the slots are arcuate, as seen in FIG. 3.

The bottom member 17 is provided with a towel access opening 22, and laterally projecting tabs 23, 24 positioned to ride in the slots 20, 21, respectively, when the bottom member 17 is moved into the container. Preferably, knobs 25, 26 are provided at the outer ends of the tabs 23, 24, respectively, for better retention of the tabs in the slots. Since the dispenser is molded of plastic as a single piece, the bottom member and tabs can be deformed a bit in order to move the knobs through the slots and position the tabs in the slots.

Figure 5:
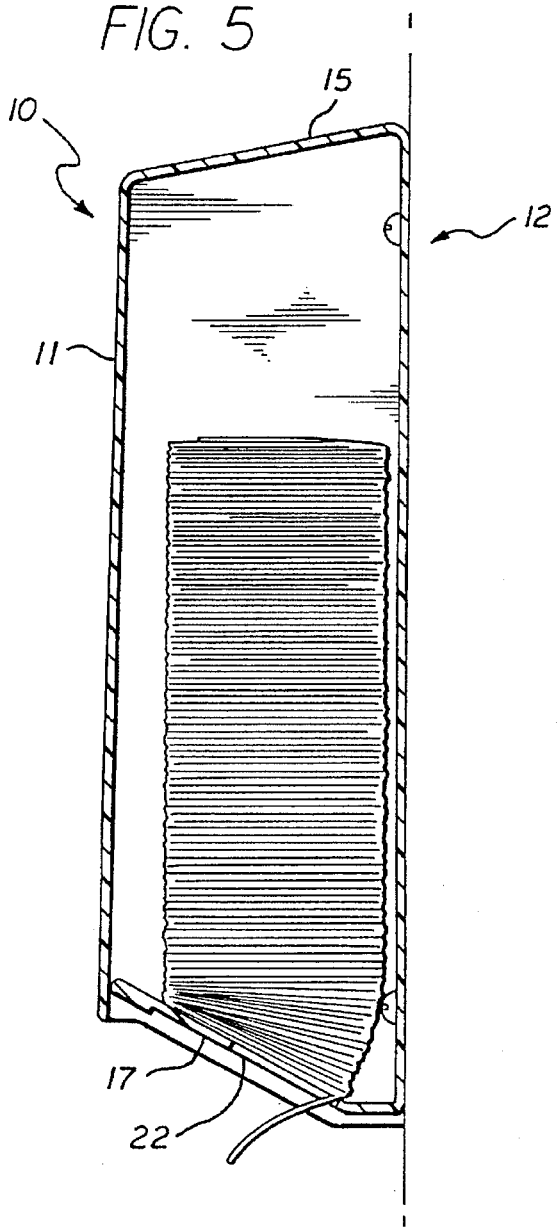
FIG. 5 is a view similar to that of FIG. 4 showing the dispenser with a stack of towels therein, ready for dispensing.

The sectional views of FIGS. 4 and 5 show the container as mounted on a wall with bolts or screws 30. Key hole shape openings are moded in the back 12 for engaging the screws. In FIG. 5, the bottom member has been positioned in the open bottom of the container, as described above, and is resting in the dispensing position with the tabs at the lower end of the slots. In FIG. 4, a stack of towels 31 is being inserted into the container, by manually pushing the stack upward against the bottom member 17. The upward pressure causes the bottom member to pivot clockwise as seen in FIG. 4, permitting passage of the stack of towels into the container. When the lower end of the stack of towels 31 passes the outer edge 32 of the bottom member 17, the bottom member pivots downwards from the loading position of FIG. 4 to the dispensing position of FIG. 5. The towels are then dispensed in the conventional manner through the access opening 22.

Thus, it is seen that the object of the invention of eliminating assembly operations is achieved by producing the towel dispenser as a single unitary molded piece.

I claim:

1. A towel dispenser consisting of a single unitary molded piece and having a container with a front, a back, right and left sides, and a top, forming a box with an open bottom, means defining a slot in each of said sides, and a bottom member joined to said back with a living hinge and having opposed tabs extending laterally for riding in said respective slots, and an access opening for passage of a towel from the interior of said container, with said bottom member moving from an initial position out of said box to a dispensing position with said tabs in said slots for closing said bottom and supporting towels thereon, and to an upward loading position into the box for insertion of towels upward into said box past said bottom member, with said bottom member returning to said dispensing position following insertion of said towels.

2. A towel dispenser as defined in claim 1 wherein said slots are arcuate and each of said tabs has a knob at the outer end of the tab.

* * * * *